US008956124B2

(12) United States Patent
Boyd et al.

(10) Patent No.: US 8,956,124 B2
(45) **Date of Patent: *Feb. 17, 2015**

(54) SAFETY RETAINING SYSTEM FOR LARGE INDUSTRIAL FAN

(71) Applicant: Macroair Technologies, Inc., San Bernadino, CA (US)

(72) Inventors: Walter Kent Boyd, Riverside, CA (US); Edward Kent Boyd, Grand Terrace, CA (US)

(73) Assignee: Macroair Technologies, Inc., San Bernardino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/052,282

(22) Filed: Oct. 11, 2013

(65) Prior Publication Data

US 2014/0093385 A1 Apr. 3, 2014

Related U.S. Application Data

(63) Continuation of application No. 13/099,759, filed on May 3, 2011, now Pat. No. 8,556,592, which is a continuation of application No. 11/735,290, filed on Apr. 13, 2007, now Pat. No. 7,955,055.

(60) Provisional application No. 60/792,309, filed on Apr. 14, 2006.

(51) Int. Cl.
*F04D 29/64* (2006.01)
*F04D 25/08* (2006.01)
(Continued)

(52) U.S. Cl.
CPC ..... *F04D 29/646* (2013.01); *F04D 25/088* (2013.01); *F04D 27/0292* (2013.01); *F04D 29/601* (2013.01)
USPC ..... 416/244 R

(58) Field of Classification Search
USPC ..... 416/244 R, 146 R, 248
See application file for complete search history.

(56) References Cited

U.S. PATENT DOCUMENTS 399,973 A 3/1889 Cassidy
681,710 A 9/1901 Kemmerer
(Continued)

FOREIGN PATENT DOCUMENTS

CN 201358962 Y * 12/2009
CN 202597136 U * 12/2012
(Continued)

OTHER PUBLICATIONS

Janus, J.M. "Analysis of Industrial Fan Designs with Gurney Flaps", 38th Aerospace Sciences Meeting and Exhibit, Jan. 10-13, 2000/ Reno, Nevada AIAA-2000-0983, pp. 1-9.
(Continued)

*Primary Examiner* — Richard Edgar
(74) *Attorney, Agent, or Firm* — Knobbe Martens Olson & Bear LLP

(57) ABSTRACT

A securing system for a fan assembly. The securing system includes a first member which attaches to a motor mount and a second member which attaches to the hub of the fan assembly. The first member is interposed between the hub and the second member such that should the shaft of the motor break, the first and second members engage with one another and inhibit the fan assembly from falling away from the motor mount.

20 Claims, 6 Drawing Sheets

(51) Int. Cl.
*F04D 27/02* (2006.01)
*F04D 29/60* (2006.01)

(56) References Cited

U.S. PATENT DOCUMENTS

| | | | |
|---|---|---|---|
| 921,744 | A | 5/1909 | Scott |
| 1,642,205 | A | 9/1927 | Hosch |
| 2,135,700 | A | 11/1938 | Cierva |
| 2,312,095 | A | 2/1943 | Welty |
| 2,450,440 | A | 10/1948 | Mills |
| 2,736,137 | A | 2/1956 | Thaheld |
| 2,906,349 | A | 9/1959 | Hans et al. |
| 3,033,049 | A | 5/1962 | Morrow |
| 3,051,072 | A | 8/1962 | Bohanon |
| 3,689,971 | A | 9/1972 | Davidson |
| 3,768,546 | A | 10/1973 | Shipes |
| 3,818,813 | A | 6/1974 | Freeman |
| 4,008,007 | A | 2/1977 | Shipes |
| 4,181,690 | A | 1/1980 | Neu |
| 4,202,655 | A | 5/1980 | Maloof |
| 4,275,993 | A | 6/1981 | Sprengling |
| 4,373,241 | A | 2/1983 | Maloof |
| 4,655,122 | A | 4/1987 | McCabe |
| 4,779,671 | A | 10/1988 | Dolison |
| 4,892,460 | A | 1/1990 | Volk |
| 4,941,803 | A | 7/1990 | Wainauski et al. |
| 4,971,521 | A | 11/1990 | Atarashi et al. |
| 5,088,665 | A | 2/1992 | Vijgen et al. |
| 5,226,783 | A | 7/1993 | Mita |
| 5,246,343 | A | 9/1993 | Windsor et al. |
| 5,328,329 | A | 7/1994 | Monroe |
| 5,492,448 | A | 2/1996 | Perry et al. |
| 5,533,865 | A | 7/1996 | Dassen et al. |
| 5,542,819 | A | 8/1996 | Bucher et al. |
| 5,567,200 | A | 10/1996 | Swartzendruber |
| 5,795,220 | A | 8/1998 | Core |
| 5,860,788 | A | 1/1999 | Sorensen |
| 5,984,640 | A | 11/1999 | Wang |
| 6,010,307 | A | 1/2000 | McCabe |
| 6,039,541 | A | 3/2000 | Parker et al. |
| 6,062,816 | A | 5/2000 | Chang |
| 6,132,181 | A | 10/2000 | McCabe |
| 6,200,099 | B1 | 3/2001 | Liao |
| 6,224,821 | B1 | 5/2001 | Kibble et al. |
| 6,244,820 | B1 | 6/2001 | Yilmaz |
| 6,244,821 | B1 | 6/2001 | Boyd et al. |
| 6,390,777 | B1 | 5/2002 | Kerr, Jr. |
| 6,431,834 | B1 | 8/2002 | Lackey et al. |
| 6,558,124 | B2 | 5/2003 | Bucher et al. |
| 6,589,016 | B2 | 7/2003 | Boyd et al. |
| 6,619,919 | B2 | 9/2003 | Kerr, Jr. |
| 6,709,238 | B2 | 3/2004 | Marshall |
| 6,733,242 | B2 | 5/2004 | Yung |
| 6,817,835 | B2 | 11/2004 | Boyd et al. |
| 6,877,703 | B2 | 4/2005 | Tang |
| 6,881,037 | B2 | 4/2005 | Marshall |
| 6,939,108 | B2 | 9/2005 | Boyd et al. |
| 7,955,055 | B1 | 6/2011 | Boyd et al. |

FOREIGN PATENT DOCUMENTS

| | | | | |
|---|---|---|---|---|
| CN | 202707556 | U | * | 1/2013 |
| CN | 202883412 | U | * | 4/2013 |
| JP | 357110796 | A | | 7/1982 |
| JP | 362243990 | A | | 10/1987 |
| JP | 405157092 | A | | 6/1993 |

OTHER PUBLICATIONS

U.S. Appl. No. 12/770,605, filed Apr. 29, 2010, Edward Boyd.

* cited by examiner

SAFETY RETAINING SYSTEM FOR LARGE INDUSTRIAL FAN

CROSS-REFERENCE TO RELATED APPLICATIONS

This application is a continuation of U.S. patent application Ser. No. 13/099,759, filed May 3, 2011, which is a continuation of U.S. patent application Ser. No. 11/735,290, filed Apr. 13, 2007, which claims the benefit of U.S. Provisional Application No. 60/792,309 filed Apr. 14, 2006 entitled Safety Retaining System for Large Industrial Fan which are hereby incorporated in their entirety herein.

BACKGROUND OF THE INVENTION

1. Field of the Invention

The present invention relates to industrial fans, such as industrial ceiling fans and, in particular, involves a safety system that inhibits the fan from falling as a result of motor shaft failure.

2. Description of the Related Art

Fans are commonly used appliances for cooling the interiors of buildings. In some industrial applications, very large fans with blades having diameters in excess of ten feet are often used to cool the interior of buildings. In some industrial applications, it is not possible or cost effective to run air conditioning systems and, in these circumstances, large fans that produce a substantial air flow can significantly reduce the ambient air temperature inside the building.

One example of the type of building that would use a fan for cooling purposes rather than an air conditioning system would be a shop-type building where welding or other fabrication is going on. In this environment, there can be a large amount of smoke or particulate air pollution necessitating constant access to fresh air for the workers therein. To achieve this, either a highly expensive air exchange system would have to be installed on the building or, more commonly, the doors and windows of the buildings are left open to provide venting for the smoke and gas by-products of the welding processes. Air exchange systems are often very expensive, but, in many locations, leaving the doors and windows open is also uncomfortable. For example, in hot weather, the inside of the building may become uncomfortably hot. To address this, fans, including large fans such as those described in U.S. Pat. No. 6,224,821 may be used to set up an airflow within the building to achieve greater cooling.

While these fans provide improved low-cost cooling within the building, it also must be recognized that these fans pose a potential hazard. Specifically, if the shaft of the motor of the fan should break or if the fan blades are hubs otherwise disengage from the shaft, the spinning fan blade could conceivably fall onto the workspace floor and potentially injure people. This problem can be exacerbated by the large size of the fans in question. As described in the U.S. Pat. No. 6,244,821, larger sized fans can produce a greater volume of moving air. These fans can have fan blades with a diameter approaching 20 feet. As such, these fans are relatively heavy and occupy a large amount of space which increases the risk to individuals working in the building should the fans fall from a ceiling mount location.

To address this particular problem, the design disclosed in the U.S. Pat. No. 6,244,821 included a lip formed on the hub that engaged with a plate formed on the motor mount. The lip will preferably catch on the plate when the motor shaft breaks thereby inhibiting the fan blade assembly from falling to the floor. While this implementation works well in the configuration of fans illustrated in the '821 patent, new designs of fans with increased numbers of blades make it more difficult to form lips on the hub that could engage a mounting assembly on the motor mount.

Hence, from the foregoing, it will be apparent that there is a need for an improved safety system that will inhibit fan blade assemblies from falling to the ground when the motor shaft of a fan motor breaks or the hub otherwise disengages from the shaft. To this end, there is a need for a more compact securing system that could be used with hub and fan assemblies that have multiple blades.

SUMMARY OF THE INVENTION

The aforementioned needs are satisfied by the fan assembly of the present invention which, in one particular implementation, comprises a fan assembly for a fan having an assembled diameter of at least five feet wherein the fan assembly comprises a motor assembly that mounts to a surface of a building wherein the motor assembly includes a fan motor having a shaft that is rotated by the fan motor and a hub that is coupled with the fan motor shaft and rotates in response to rotation of the fan motor shaft wherein the hub is configured to receive a plurality of fan blades having length in excess of five feet such that rotation of the hub results in rotation of the fan blades. In this implementation, the motor assembly and the rotor define an interface and a retaining system is mounted in the interface defined by the motor assembly and the hub. The retaining system couples the rotor to the motor assembly such that in the event of the motor shaft breaking or the hub otherwise disengages from the shaft, the hub is inhibited from falling from the motor assembly.

In one particular implementation, the retaining system is positioned between the rotor and the fan motor about the shaft of the fan motor such that the retaining system can be factory installed prior to shipping of the assembly. In one particular implementation, the retaining system comprises a first member mounted to the motor assembly and a second member mounted to the hub wherein the first member is interposed between the hub and the second member such that, if the motor shaft breaks or the hub otherwise disengages from the shaft, the second members falls into engagement with the first member and thereby inhibits the rotor and the attached plurality of fan blades from falling away further from the motor assembly. And in one very specific implementation, the first member defines a planar member having an aperture sized to receive the motor shaft therethrough and the second member defines a planar member that is sized so as to be inhibited from falling through the aperture in the first member.

By positioning the retaining member at the interface between the shaft and the motor hub, a smaller more compact factory installed securing system can be utilized. These and other objects and advantages of the present invention will become more apparent from the following description taken in conjunction with the accompanying drawings.

DETAILED DESCRIPTION OF THE ILLUSTRATED EMBODIMENT

Figure 1:
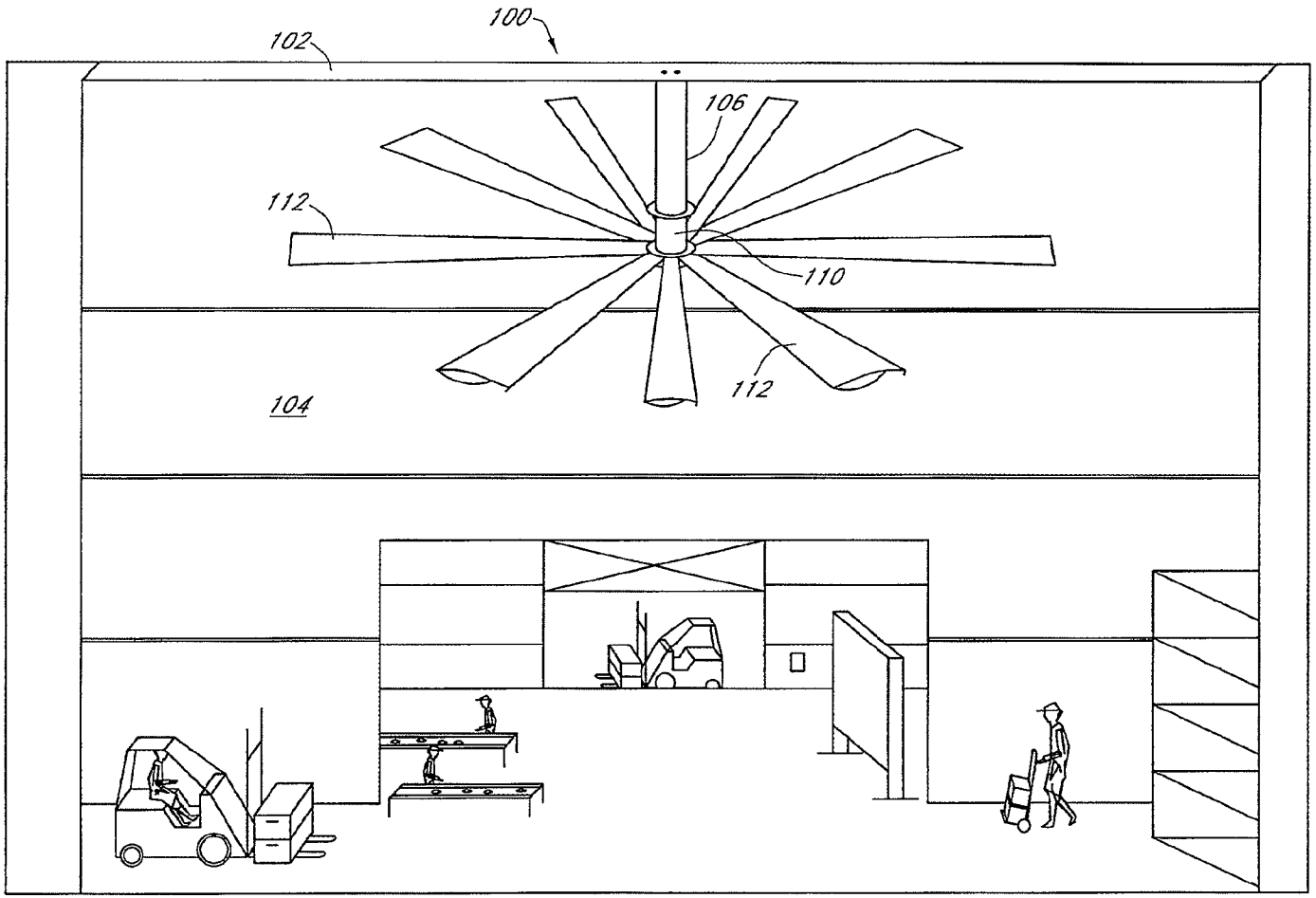
FIG. 1 is a perspective view of an exemplary fan used for cooling the interior of an industrial-type building.

Reference will now be made to the drawings wherein like numerals refer to like parts throughout. FIG. 1 illustrates a fan assembly 100 mounted to an interior wall 102 of a building 104. In this particular implementation, the fan assembly is shown as being mounted to the ceiling 102, however, it will be appreciated that large industrial-type cooling fans can also be mounted to side walls of the building without departing from the spirit of the present invention. As is generally shown in FIG. 1, the fan assembly includes a motor mount 106 that attaches the fan to the interior wall 102 of the building 104, a hub 110 which is rotatably engaged with the motor mount 106 and a plurality of fan blades 112 that extend radially outward from the hub 110. In this particular implementation, the fan blades extend generally a distance of approximately at least five feet from the hub and, more particularly, at least 10 feet, and the fan preferably rotates at a speed that induces air to be circulated through the building 100 thereby providing cooling effects to the people working below. The fan assembly can be similar to the fan assemblies disclosed in U.S. Pat. No. 6,224,821 and U.S. Pat. No. 6,939,108 which are hereby incorporated by reference in their entirety.

Figure 2A:
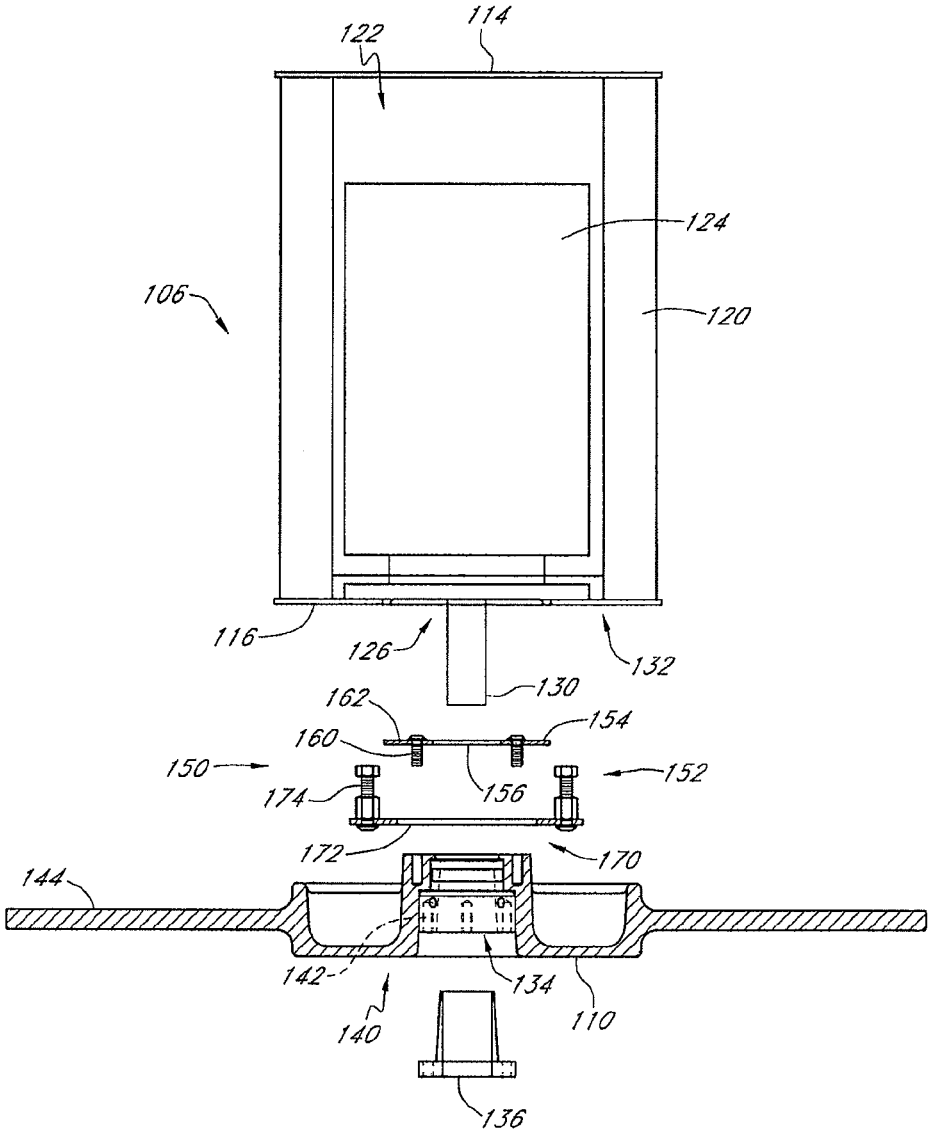
FIG. 2A is an exploded perspective view of one embodiment of a fan having a compact securing system that secures the hub of the fan and attached blade to the motor mount in the event of a motor shaft failure.
Figure 2B:
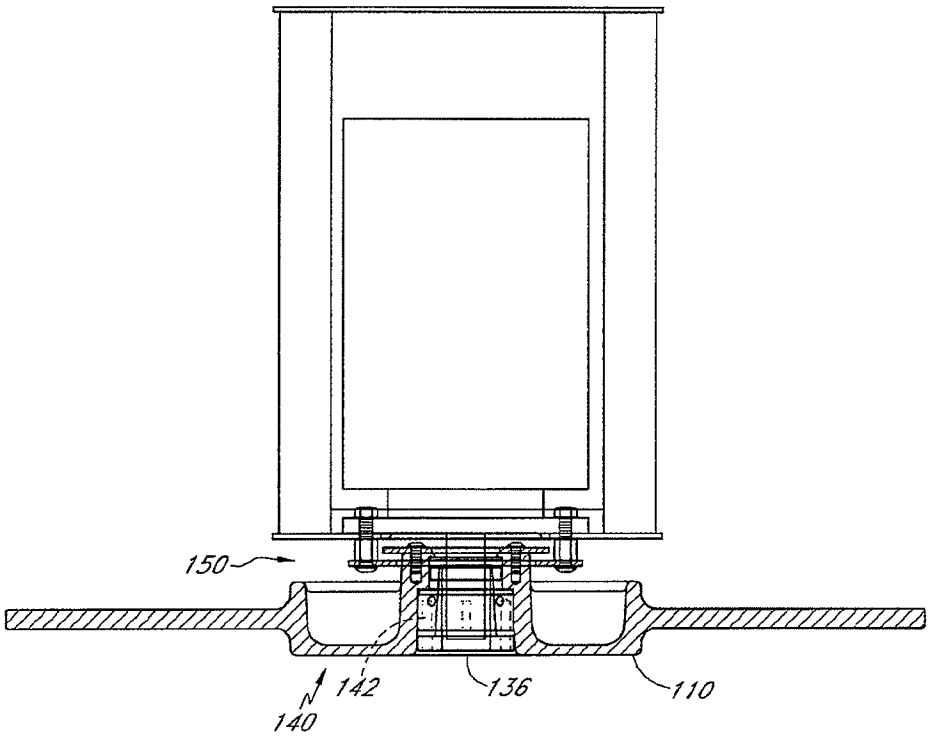
FIG. 2B is an assembled cross-sectional view of the fan of FIG. 2A.
Figure 2C:
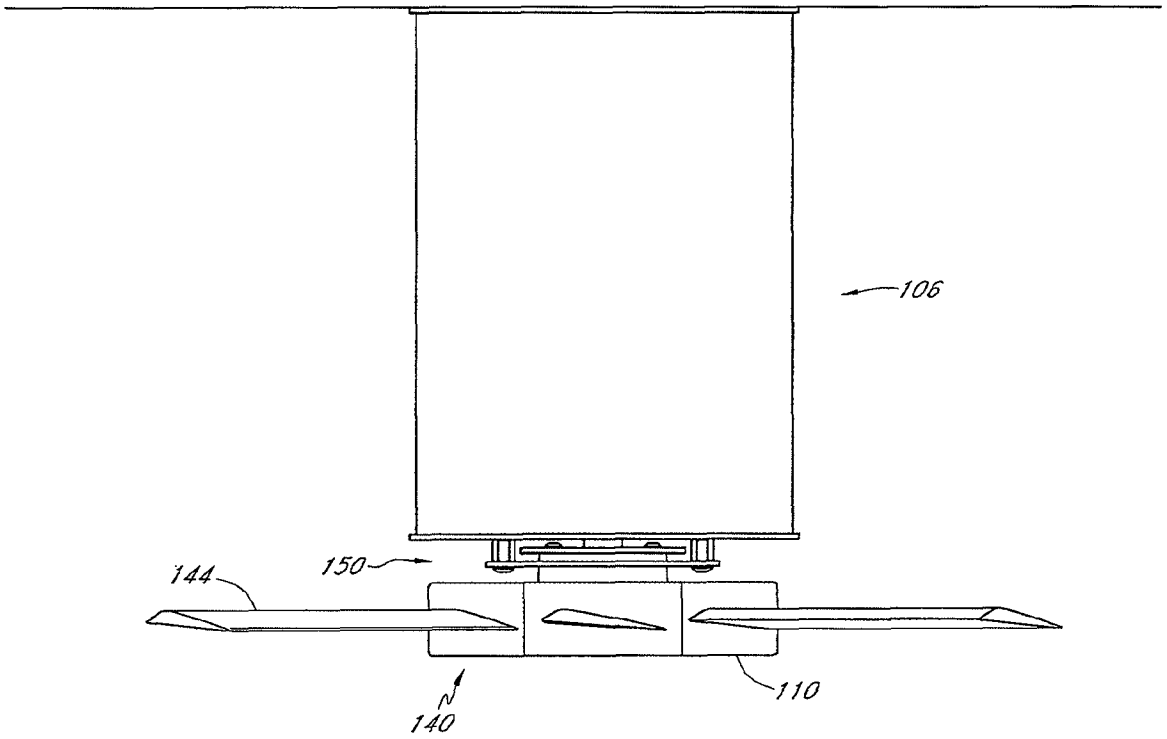
FIG. 2C is a perspective of the fan of FIG. 2A in an assembled state.

FIGS. 2A-2C illustrate the fan assembly 100 in greater detail. As is indicated, the fan assembly 100 includes a motor mount 106. In this particular implementation, the motor mount 106 includes two plates 114 and 116 that are spaced apart by a plurality of vertical members 120. The plates 114, 116 and the vertical members 120 can be formed of a strong material such as steel and, when assembled, they define an interior space 122 which is adapted to receive a motor 124 of the fan assembly 100. In particular, the motor 124 is mounted on the lower plate 116 through the use of bolts and the like. The lower plate 116 includes an opening 126 through which a motor shaft 130 extends. The size of the motor and shaft will, of course, vary depending upon the particular size of fan and the implementation of the fan assembly.

As is also illustrated in FIGS. 2A-2C, the fan assembly 100 includes the hub 110 which mounts to the motor shaft 130 adjacent the lower side 132 of the plate 116. Specifically, in this particular implementation, the hub 110 defines a throughgoing aperture 134 that receives the motor shaft 130 and a locking member 136 is then attached to the shaft to thereby secure the hub 110 onto the shaft 130 such that when the shaft 130 rotates the hub will, in turn, rotate as well. In one particular implementation, the locking member 136 comprises a flanged collar that is positioned upward through the hub aperture 134 so as to be secured to the motor shaft 130 via friction or fasteners and is further secured to the underside 140 of the hub 110 via fasteners 142 which are shown in phantom in FIG. 2B. The hub includes a plurality of mounting plates 144 to which the fan blades 112 (FIG. 1) attach in a known manner.

As is shown in FIGS. 2A-2C, the motor shaft 130 and the hub 110 define an interface 150 which receives a securing assembly 152 that inhibits the hub from falling when the motor shaft breaks or the hub otherwise disengages from the shaft. In this particular implementation, the securing assembly 152 comprises a first member 154 that has an opening 156 that is sized so that the motor shaft 132 can be positioned therethrough. The first member 154 is adapted to be attached to the hub 110 via fasteners 160, such as bolts. The first member 154 preferably defines a flanged surface 162 that have a first cross-sectional dimension.

The securing assembly shown in FIGS. 2A and 2B, further includes a second member 170 that also has an opening 172 that is sized so as to allow the motor shaft 170 to extend therethrough. In this implementation, the opening 172 is also sized so as to allow the fasteners 160 of the first securing member 154 to also extend through the opening 172 and engage with the hub 110 in the previously described fashion. However, the opening is further sized such that the flanged surface 162 of the first member 154 extending in the first cross-sectional dimension is greater than the cross-sectional dimension of the opening 172 such that the first securing member 154 cannot be pushed or pulled through the opening 172. The second securing member 170 is attached to the lower plate 116 of the motor mount be a fastener 174 such as bolts. Hence, in an assembled form, the second member 170 is interposed between the first member 154 and the hub 110. Since the second member 170 is attached to the motor mount and the first securing member 154 is attached to the hub, should the motor shaft 130 break or the hub otherwise disengages from the shaft, the first member 154 will engage with the second securing member 170 thereby preventing the hub and attached fan blades from falling away from the motor mount 106.

Figure 3A:
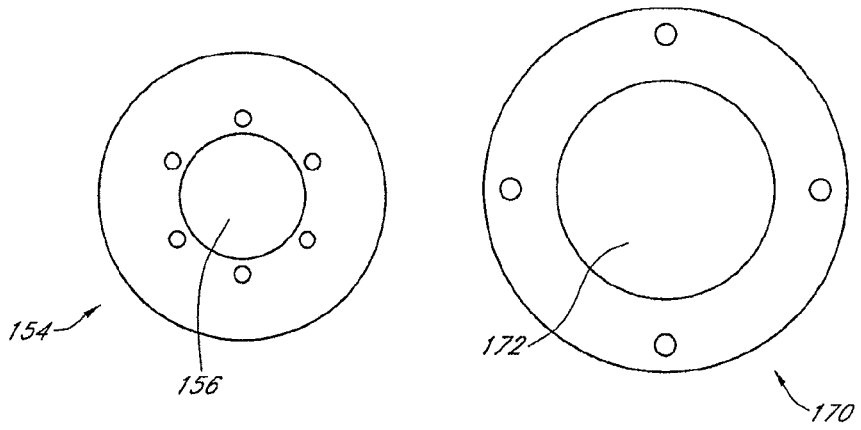
FIGS. 3A and 3B comprise a first embodiment of a securing assembly used in the fans of FIGS. 2A and 2B.
Figure 3B:
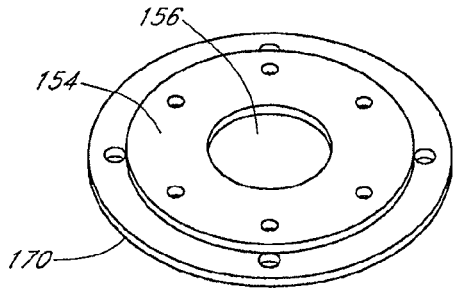
Figure 4A:
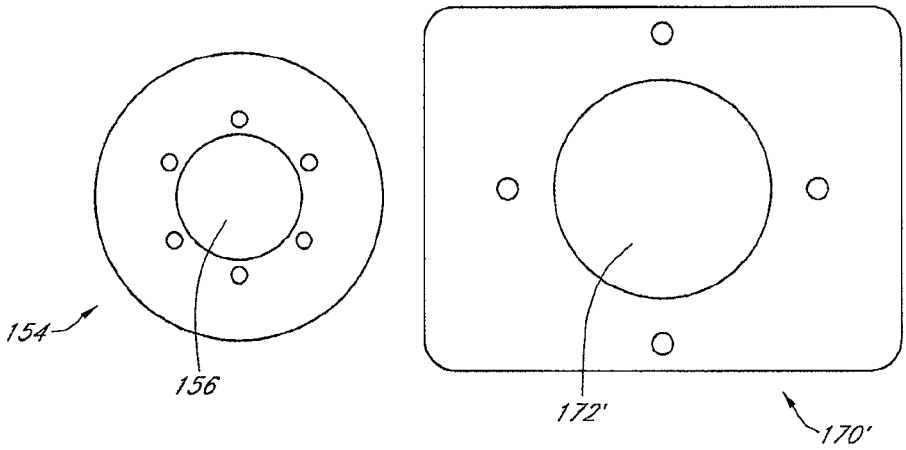
FIGS. 4A and 4B comprise a second embodiment of a securing assembly used in the fans of FIGS. 2A and 2B.
Figure 4B:
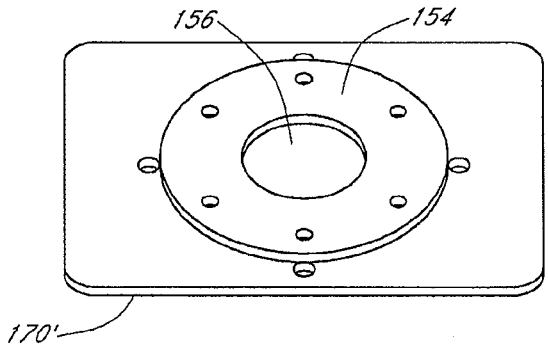

FIGS. 3A and 3B illustrate one possible configuration of the first and second securing members 154, 170. In this particular implementation, the securing members 154, 170 are generally circular in shape, however, it will be appreciated that the second securing member need not be circular in shape as is illustrated by the embodiment of FIGS. 4A and 4B. In essence, the flanged surfaces 162 of the first member 154 simply has to be larger than the cross-sectional width of the opening 172 formed in the second member 170 and the shape of the first and second securing members can thus be any of a number of shapes. The advantage of the securing assembly 152 illustrated herein is that it can be preassembled onto the various components of the fan prior to shipment assuming that the hub is mounted on the shaft 130 during the shipping process. Moreover, by centrally mounting the first and second securing members 150, 170 about the axis defined by the motor shaft 130, a more compact securing system can be employed. Further, this type of securing system uses well-known members, such as washer plates and the like, and does not require sophisticated molding of the cast hub.

Although the above-disclosed embodiments of the present teachings have shown, described and pointed out the fundamental novel features of the invention as applied to the above-disclosed embodiments, it should be understood that various omissions, substitutions and changes in the form of the details of the devices, systems and/or methods illustrated may be made by those skilled in the art without departing from the scope of the present teachings. Consequently, the scope of the invention should not be limited to the foregoing description but should be defined by the appended claims.

What is claimed is:

1. An industrial fan comprising:

a mounting assembly that is adapted to mount the fan to a surface of a building;

a motor that is mounted to the mounting assembly, wherein the motor defines a shaft;

a hub assembly that couples to the shaft of the motor such that rotation of the motor shaft results in rotation of the hub;

a plurality of fan blades that mount to the hub assembly; and a securing assembly interposed between the hub and the mounting assembly, wherein the securing assembly comprising a first member that is coupled to the hub and a second member that is coupled to the mounting assembly and wherein the first and second members are dimensioned with respect to each other such that the hub is inhibited from falling when the motor shaft breaks or the hub otherwise disengages from the shaft and wherein the second member is interposed between the first member and the hub.

2. The fan of claim 1, wherein the mounting assembly comprises a first plate, a second plate and a plurality of vertically extending members interposed therebetween wherein the first and second plate defines a space that is adapted to receive the motor so that the motor is mounted on the first plate and the second plate is coupled to the surface of the building.

3. The fan of claim 2, wherein the second plate of the mounting assembly is adapted to be mounted to the ceiling of a building with the fan motor and shaft extending downward therefrom.

4. The fan of claim 1, wherein the hub assembly defines an aperture that receives the motor shaft.

5. The fan of claim 4, wherein the hub assembly includes a retainer that engages with the motor shaft so as to secure the hub assembly onto the motor shaft.

6. The fan of claim 1, wherein the fan blades comprise blades that have a length of at least 5 feet.

7. The fan of claim 6, wherein the fan blades have a length of at least 10 feet.

8. The fan of claim 1, wherein the first member of the securing assembly defines an opening that is sized to a first dimension so as to allow the motor shaft to extend therethrough and wherein the first member defines a flanged surface wherein fasteners couple the flanged surface to the hub assembly.

9. The fan of claim 8, wherein the second member of the securing assembly defines an opening that is sized to a second dimension so as to allow the motor shaft and the fasteners of the first member to extend therethough and be coupled to the hub assembly and wherein the second member includes a flanged surface that is positioned outward of the flanged surface of the first member so that fasteners couple the second member to the second plate of the mounting assembly.

10. The fan of claim 9, wherein the first and second members of the securing assembly defines generally circular members with circular openings.

11. The fan of claim 9, wherein at least one of the first and second members of the securing assembly defines a rectangular shaped member.

12. A fan assembly comprising:

a motor that is adapted to be mounted to a building surface, wherein the motor includes a housing and motor shaft that extends in a first direction;

a hub assembly that is adapted to be coupled to the motor shaft;

a plurality of fan blades that are adapted to be coupled to the hub assembly;

a first securing member that is mechanically coupled to the hub;

a second securing member that is adapted to be mechanically coupled to the motor housing, wherein the first and second securing members are positioned and dimensioned with respect to each other such that, in the event of the motor shaft breaking or the hub otherwise disengaging from the shaft, the second securing member engages with the first securing member so as to inhibit the hub assembly from falling.

13. The assembly of claim 12, further comprising a mounting assembly that couples the motor housing to the building surface and wherein the second securing member is mechanically coupled to the motor housing via the mounting assembly.

14. The fan of claim 12, wherein the hub assembly defines an aperture that receives the motor shaft.

15. The fan of claim 14, wherein the hub assembly includes a retainer that engages with the motor shaft so as to secure the hub assembly onto the motor shaft.

16. The fan of claim 12, wherein the fan blades comprise blades that have a length of at least 5 feet.

17. The fan of claim 16, wherein the fan blades have a length of at least 10 feet.

18. The fan of claim 12, wherein the first securing member defines an opening that is sized to a first dimension so as to allow the motor shaft to extend therethrough and wherein the first securing member defines a flanged surface wherein fasteners couple the flanged surface to the hub assembly.

19. The fan of claim 18, wherein the second securing member defines an opening that is sized to a second dimension so as to allow the motor shaft and the fasteners of the first securing member to extend therethough and be coupled to the hub assembly and wherein the second securing member includes a flanged surface that is positioned outward of the flanged surface of the first securing member so that fasteners couple the second securing member to the motor housing.

20. The fan of claim 19, wherein the first securing member and the second securing member define generally circular members with circular openings.

* * * * *